United States Patent [19]

Barrett et al.

[11] Patent Number: 4,719,864

[45] Date of Patent: Jan. 19, 1988

[54] LIMP MATERIAL SEAM JOINING APPARATUS WITH ROTATABLE LIMP MATERIAL FEED ASSEMBLY

[75] Inventors: David S. Barrett, Needham; William B. Costain, West Newbury, both of Mass.

[73] Assignee: The Charles Stark Draper Laboratory, Inc., Cambridge, Mass.

[21] Appl. No.: 48,373

[22] Filed: May 11, 1987

[51] Int. Cl.[4] ..... D05B 21/00; D05B 27/14

[52] U.S. Cl. ..... 112/121.12; 112/304; 112/309; 112/153

[58] Field of Search ..... 112/121.12, 121.11, 112/121.15, 308, 309, 304, 153

[56] References Cited

U.S. PATENT DOCUMENTS

| | | | |
|---|---|---|---|
| 3,650,229 | 3/1972 | Rovin | 112/153 |
| 3,693,561 | 9/1972 | Hrinko, Jr. et al. | 112/308 |
| 4,100,864 | 7/1978 | Babson et al. | 112/121.11 |
| 4,512,269 | 4/1985 | Bowditch | 112/121.12 |
| 4,572,243 | 7/1984 | Bowditch | 112/121.14 |
| 4,632,046 | 12/1986 | Barrett et al. | 112/121.14 |

*Primary Examiner*—H. Hampton Hunter
*Attorney, Agent, or Firm*—Lahive & Cockfield

[57] ABSTRACT

A sewing machine system adapted for joining portions of a multiple layer limp fabric workpiece includes a workpiece support surface and a sewing head assembly. The sewing head assembly houses an elongated needle adapted for reciprocating motion along a needle axis extending through an aperture in the workpiece support surface. A selectively operable feeder is adapted to transport a region of a limp fabric workpiece on the workpiece support surface in the direction of a feed axis having a fixed orientation with respect to the feeder. A coupling assembly rotatably couples the feeder to the sewing head assembly so that the feeder is selectively rotatable about the needle axis. A feed controller controls the feeder and includes an orientation controller adapted to selectively control the angular orientation of the feeder with respect to the sewing head assembly so that the feed axis may be adjustably offset with respect to a reference axis on the workpiece support surface. The feeder includes a feeder frame, an endless belt assembly coupled to the frame, and an associated drive motor and linkage adapted to drive the belt assembly to selectively adjust the angle of presentation for a limp fabric workpiece to the needle of the sewing head assembly.

5 Claims, 8 Drawing Figures

LIMP MATERIAL SEAM JOINING APPARATUS WITH ROTATABLE LIMP MATERIAL FEED ASSEMBLY

BACKGROUND OF THE INVENTION

The present invention is in the field of assembly systems for articles made of limp material, and more particularly related to sewing machines.

Sewing machines are well known in the prior art to join portions of a multiple layer limp fabric (or material) workpiece along a curvilinear path, thereby forming a seam. Generally, such systems include a needle adapted for reciprocating motion along a needle axis which is angularly offset from a planar workpiece support surface. The needle is operated in conjunction with an associated bobbin assembly positioned below the workpiece support surface. In most prior art sewing machines, manually or automatically controlled, feed devices present the fabric-to-be-joined is fed to the needle along a feed axis which is fixedly positioned with respect to the needle axis and the workpiece support surface. By way of example, such devices include feed dogs, rolling cylinder feeds and tractor feeds (using endless belts over rollers). U.S. Pat. No. 4,457,243 illustrates a prior art system in which the fabric-to-be-joined is generally advanced toward the needle along a feed axis, while the needle assembly is translatable along an axis transverse to the feed axis to permit a two degree of freedom seam trajectory.

All of such prior art sewing machine systems are very effective in forming straight line seams, but are less effective in providing precision curved seams, as are often required in the assembly of fabric panels to form articles of clothing, for example.

In order to sew a high precision curved seam, during the sewing operation, the fabric-to-be-joined must be presented, or fed, to the needle in the direction of the desired seam. Such a precision curved seam is optimally generated by rotating the fabric-to-be-joined with respect to the sewing head and feed device, or by rotating the sewing head and feed device with respect to the fabric-to-be-joined.

The belts of the sewing machine system of U.S. Pat. No. 4,457,243 can be individually driven to rotate workpiece with respect to a fixed position sewing head and workpiece support surface, prior to or during presentation of the workpiece to the needle. Rotation of the workpiece during sewing is only effective to a limited extent with such systems.

U.S. Pat. No. 4,632,046 illustrates a sewing machine system in which the entire sewing machine head, including the feed device, may be rotated about the needle axis, while maintaining the fabric-to-be-joined in a fixed orientation. Such systems require relatively large and complex assemblies to accomplish these motions.

U.S. Pat. No. 4,512,269 illustrates a prior art seam joining system in which the sewing head, and an associated feed dog assembly, is rotatable about the needle axis, while the remainder of the machine, including the workpiece support surface is maintained stationary.

In the latter-mentioned prior art systems, however, the angle of fabric presentation to the sewing head may be adjusted to establish an improved high precision curved seam compared to the earlier-developed systems, but there is limited near-needle control of the fabric workpiece. Particularly in automated sewing, when workpieces need to be sewn along curvilinear paths, with or without precision easing, the amount of position control of the workpiece near the needle greatly effects the quality of the seam and seam trajectory.

Accordingly, it is an object to provide an improved sewing machine for generating curved or straight seams in a limp fabric workpiece.

It is another object of the present invention to provide an improved sewing machine system having highly accurate near-needle control of the fabric-to-be-joined.

Yet another object is to provide an improved automated sewing machine system for generating curved or straight seams with easing in a limp fabric workpiece.

SUMMARY OF THE INVENTION

The present invention is a sewing machine system adapted for joining portions of a multiple layer limp fabric workpiece. The sewing machine system includes a substantially planar workpiece support surface. The system further includes a sewing head assembly which houses an elongated needle and an associated driver for driving the needle along a needle axis which is angularly offset from the principal plane of the support surface. The needle may be driven so that the tip of the needle passes in a reciprocating motion through an aperture in the support surface. Sewing is accomplished in conjunction with an associated bobbin assembly psitioned below the workpiece support surface. The system further includes a selectively operable feeder for transporting a region of a limp fabric workpiece on the workpiece support surface and adjacent to the needle axis in the direction of a feed axis, where the feed axis has a fixed orientation with respect to the feeder. A coupling assembly rotatably couples the feeder to the sewing head assembly so that the feeder is selectively rotatable about the needle axis.

A controller, preferably in the form of a programmed digital computer, includes a feed controller adapted to selectively control the feeder to be operative to transport the workpiece along the feed axis. The controller further includes an orientation controller adapted to selectively control the angular orientation of the feeder with respect to the sewing head assembly so that the feed axis may be adjustably offset at any angle with respect to a reference axis on the workpiece support surface.

The feeder includes a feeder frame, an endless belt assembly coupled to the frame, and an associated drive motor and linkage adapted to drive the belt assembly. The belt assembly may include one or more endless belts. In one form, belt assembly includes a pair of endless belts on opposite sides of the needle, with each belt being disposed about an associated set of rotatable support members affixed to the feeder frame. The drive motor is adapted to drive the belts in tandem, or independently. Each of the belts has an elongated portion of its outer, lowermost surface lying substantially in a reference plane, where the reference plane is substantially parallel to and above the plane of the workpiece support surface in a region adjacent to the aperture. The portions of the outer surfaces of the belts are adapted for motion along respective belt axes which lie in the reference plane, are mutually parallel, and are disposed on opposite sides of the needle axis. Preferably, the belts include outer surfaces adapted to engage the limp material workpiece with a relatively high coefficient of friction.

With this configuration, the controller may selectively adjust the angle of presentation for a limp fabric workpiece to the needle of the sewing head assembly. The elongated portions of the belts which contact the upper layer of the workpiece provide highly precise positional control of that workpiece, particularly in the near-needle regions. As a consequence, high precision straight or curved seams may be sewn in the workpiece. Further, the differential feed rates may be established for the upper and lower layers of the workpiece, such that curvilinear seams may be generated with high precision easing as well. The present invention is particularly well suited for use in an automated article assembly system where the there are a minimum number of operators needed to maintain and control the position and movement of the limp material workpiece near the point of sewing.

In various forms of the invention, a bias assembly may be incorporated in the system which may selectively bias the portions of the outer belts in the direction toward the workpiece support surface, particularly useful in the sewing mode, or lift away those belt portions from that support surface, permitting free movement of the workpiece between sewing operations.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
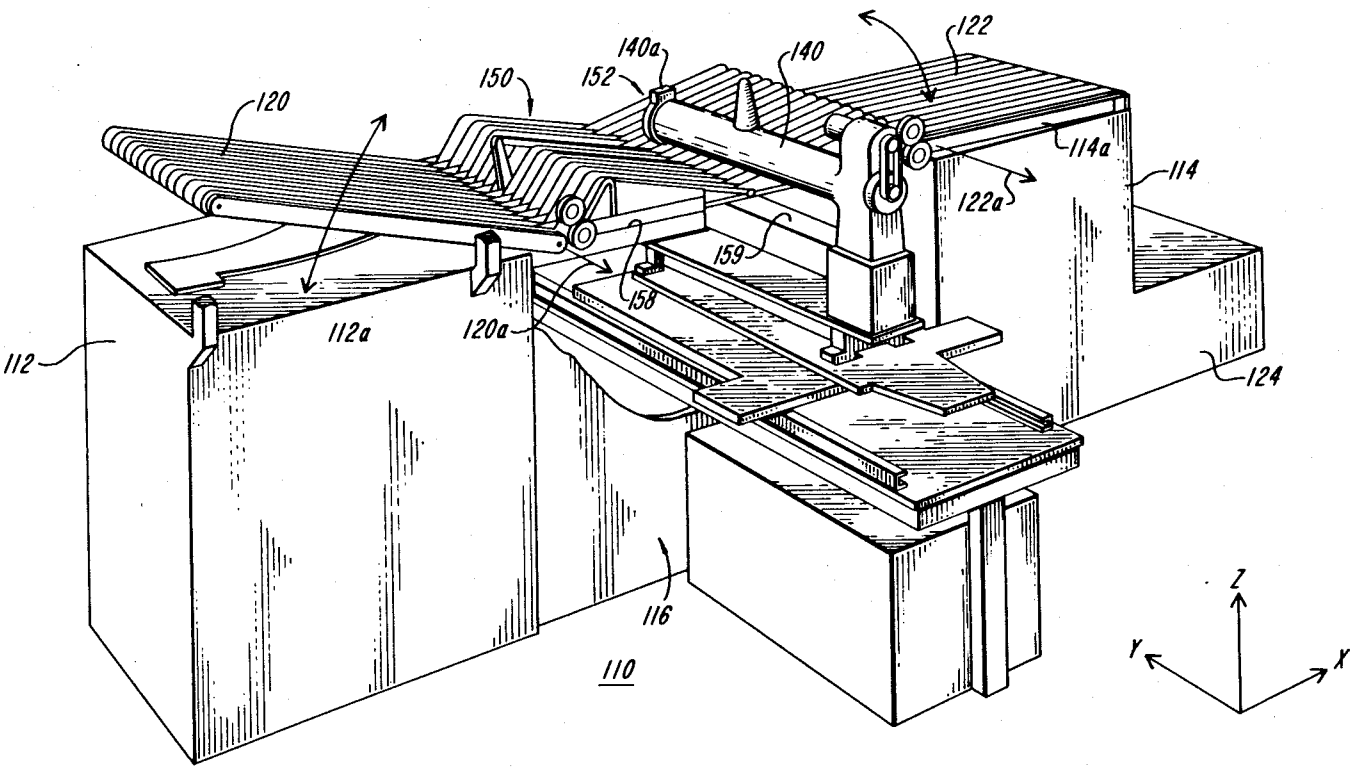
FIG. 1 shows an isometric representation of the principal elements of an exemplary embodiment of an article assembly system embodying the present invention.

FIG. 1 shows an isometric representation of principal elements of a preferred form of an assembly (or sewing machine) system 110 together with a set of intersecting reference coordinate axes X, Y and Z. The system 110 includes two support tables 112 and 114 and a seam joining assembly 116. Generally, the assembly system 110 is similar to the system disclosed in U.S. Pat. No. 4,632,046 and elements of assembly system 110 which correspond to elements in the system of that patent are identified with the same reference designations. As shown in FIG. 1, system 110 does not include a vision sub-system and a manipulator (folding) sub-system, but various embodiments may incorporate such sub-systems, such as in the form disclosed in U.S. Pat. No. 4,632,046 or in other forms.

As shown in FIG. 1, each of the support tables 112 and 114 includes a respective one of planar upper surfaces 112*a* and 114*a*. In alternative embodiments, other or both of the surfaces 112*a* and 114*a* may differ from planar. For example, those surfaces may be cylindrical about an axis parallel to the Y axis.

A set of parallel endless belts (120 and 122) is affixed to each of tables 112 and 114. Each set of belts 120 and 122 is pivotable about a respective one of axes 120*a* and 122*a* each of which is parallel to the Y axis from a position substantially parallel to one of surfaces 112*a* and 114*a* (closed) to a position substantially perpendicular to one of those surfaces (open). In FIG. 1, belt set 120 is shown in a partially open position, and belt set 122 is shown in a closed position substantially parallel to the top surface 114*a* of table 114.

The sewing assembly 116 includes a sewing machine 140 adapted for linear motion along the Y axis. The sewing assembly 116 further includes an interlocking belt assembly including a first set of parallel endless belts 150 and a second set of parallel endless belts 152. The belts of sets 150 and 152 are adapted so that their lower surface may frictionally drive material between those lower surfaces and an underlying workpiece support surface 158 (which is generally continuous with surfaces 112*a* and 114*a*) under the control of the controller 124.

As described more fully below in conjunction with FIGS. 4 and 5, the sewing machine 140 includes a substantially planar workpiece support element 159 (which form a part of support surface 158, as described below), a sewing head 140*a*, a bobbin assembly (not shown) below element 159, and an associated drive assembly (which is operative under the control of controller 124). The sewing head 140*a* includes a needle 202 extending along a needle axis 202*a* which passes through an aperture 159*a* in the support element 159. The axis 202*a* is offset from the principal plane of support element 159. The sewing machine 140 is adapted in a conventional manner to selectively drive the needle 202 in a reciprocal motion along the needle axis 202*a* in conjunction with the bobbin assembly for seam joining operation.

Figure 2:
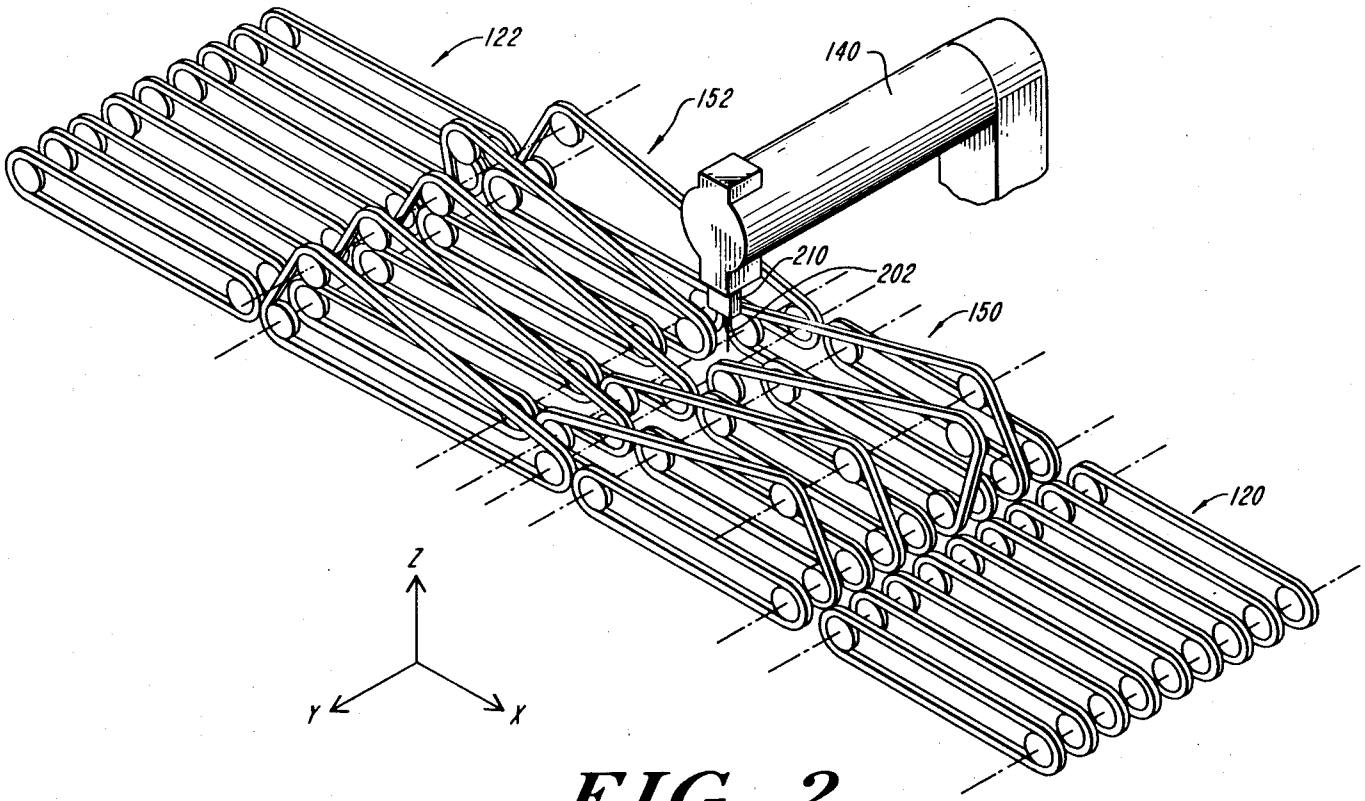
FIG. 2 shows a schematic representation of the upper endless belts of the system of FIG. 1.

FIG. 2 shows the belt assemblies 120, 150, 152, and 122, in schematic form, together with the sewing machine 140, wherein the belt sets 150 and 152 include alternating sets of three roller endless belts and two roller endless belts. In operation, the controller 124 controls the three roller belt adjacent to the sewing head of sewing machine 140 to be retracted from the locus of the needle 202 while that needle is in the region between that belt and its opposed two roller belt. Otherwise, ends of the belts of the opposed sets 150 and 152 are adjacent to each other. The belts may be driven by controller 124 in a manner providing controlled fabric tension for fabric between the lower surface of the belts of sets 150 and 152 and the upper surface 158, particularly in regions away from the immediate neighborhood of the needle axis 202*a* (i.e. the region of the retracted belt).

In the present embodiment of the invention, the surface 158 includes multiple endless belt assemblies 151 and 153 underlying respective belts of sets 150 and 152. The upper surfaces of the belts of sets 151 and 153, together with a planar element surrounding those upper surfaces, together with element 159 form the support element 158. The latter belt sets 151 and 153 are also controlled by the controller 124 in order to achieve substantially independent control of upper and lower layers of fabric positioned between the sets of belts 150 and 152 and the underlying sets 151 and 153, (exemplified by belts 151*a* and 153*a* in FIG. 4, below).

By way of example, the belts may be 0.03 to 0.04 inches thick, ⅜ inch wide neoprene toothed timing belts with polyester fiber reinforcement supported by toothed roller assemblies. A layer of polyurethane foam is attached to the other belt surfaces with adhesive. With this configuration, the foam provide substantial frictional contact with material adjacent to the belts so that as the belt moves, it positions the fabric adjacent thereto in the corresponding manner. For the upper belts the layer is ⅜ inches thick and for the lower belts the layer is ⅛ inches thick. The thicker layer provides increased adaptablility for materials characterized by varying thicknesses.

Figure 3A:
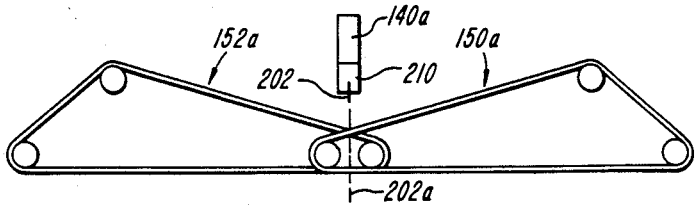
FIGS. 3A and 3B illustrate the operation of the retractable belts of the system of FIG. 1.
Figure 3B:
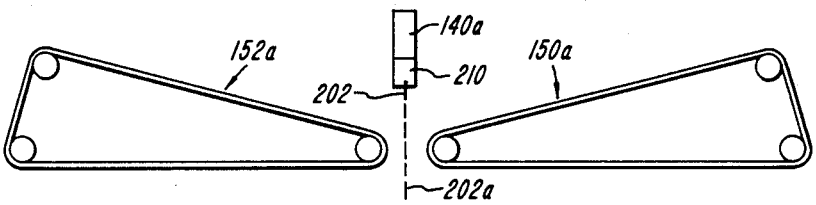

FIG. 3A shows two interlocking belts 150*a* and 152*a* of the sets 150 and 152, in a first state, where the sewing machine head 140*a* is positioned other than between these two belts. FIG. 3B shows those same interlocking belts in a second state when the sewing head 140*a* is positioned between those two belts 150*a* and 152*a*. As shown in FIGS. 3A and 3B, each of belts 150*a* and 152*a* is positioned about three rollers, one of which is fixed (the rightmost roller shown in FIGS. 3A and 3B for belt 150*a*, and the leftmost roller shown in FIGS. 3A and 3B for belt 152*a*) and the other two of which for each of belts 150*a* and 152*a* are controllably positioned. With the present embodiment, as limp fabric to be sewn is adjustably positioned between the belts of sets of 150 and 152 and the surface 158, the sewing machine 140 may be selectively controlled to traverse the gaps established by the retracting belts along axis parallel to the Y axis of machine 140 so that selective stitching may be accomplished on that fabric, under the control of controller 124.

In operation, the belt assemblies control the portions of multiple layers of limp fabric workpiece along a reference (X) axis with respect to the needle on the workpiece surface 158. As disclosed in U.S. Pat. No. 4,632,046, the belt drive material feed assemblies may selectively move upper and lower layers of a multiple layer assemblage of material at different feed rates (for example, to permit easing). Thus, the belt drive material feed assemblies in the preferred embodiment include individually retractable belts, such as those disclosed in U.S. Pat. Nos. 4,457,243 and 4,632,046 to optimize material control of the principal regions of the workpiece, particularly in regions of the workpiece other than those immediately surrounding the needle.

The assembly system 110 further includes a near-needle fabric feeder assembly 210. That assembly 210 is indicated only generally in FIGS. 1–3B, but is described in detail below in conjunction with FIGS. 4 and 5. Generally, assembly 210 is disposed adjacent to and about the needle 202. The feeder assembly 210 includes a feeder 212 and a coupler 214.

As described more fully below, the coupler 214 is rotatably (about needle axis 202*a*) coupled to the sewing head 140*a* of machine 140. The feeder 212 is affixed to (and is rotatable with) the coupler 214. The feeder 212 includes a pair of endless belts 220 and 222, having lowermost outer surfaces lying substantially in a plane parallel to the principal plane of element 159 of the workpiece support surface 158. The outer surface of those belts may be polyurethane foam, or some other material adapted to frictionally engage the upper layer of the workpiece which might be between those belt portions and support surface element 159. The support assembly for the belts 220 and 222 (described more fully below) may selectively raise those belt portions away from surface element 158 or bias those portions toward the surface element 158. The belts, when 220 and 222 are biased toward surface element 158, may be selectively driven by the controller 124 to drive the underlying portion of the upper layer of the workpiece in the direction of a feed axis substantially parallel to the principal plane of surface element 158. In alternate embodiments, the feeder 212 may include a different number of endless belts, for example a single belt, or three or more belts in place of belts 220 and 222.

While in the present embodiment, the workpiece support surface 158 is planar, that surface may have other shapes (for example, cylindrical with a radius relatively large compared to the gap between belt material drive assemblies 150 and 151 and belt material drive assemblies 152 and 153). Such other shapes fall within the definition of "substantially planar" work surfaces as used herein.

The assembly system 110 further includes drive motors and linkages which operate under the control of controller 124 to selectively rotate the coupler 212 (and feeder 210 affixed thereto) about needle axis 202*a* and to selectively drive the belts 220 and 222 to provide near-needle control of the position of the upper layer of the workpiece along any desired direction in a full 360 degree range (R) about needle axis 202*a*. In other embodiments, the range (R) may be limited.

With this configuration and rotatable sewing head and feed control, high precision curvilinear seams may be sewn without having to rotate the entire sewing machine with respect to the material being sewn, or rotating the material with respect to the sewing machine, i.e., the principal approaches of the prior art. The quality of easing in these seams may also be precisely controlled. These advantages increase in importance when the sewing machine is automatically controlled and is used in conjunction with automated machinery and there are no operators to maintain and control the position and movement of the limp material workpiece near the point of sewing.

Figure 4:
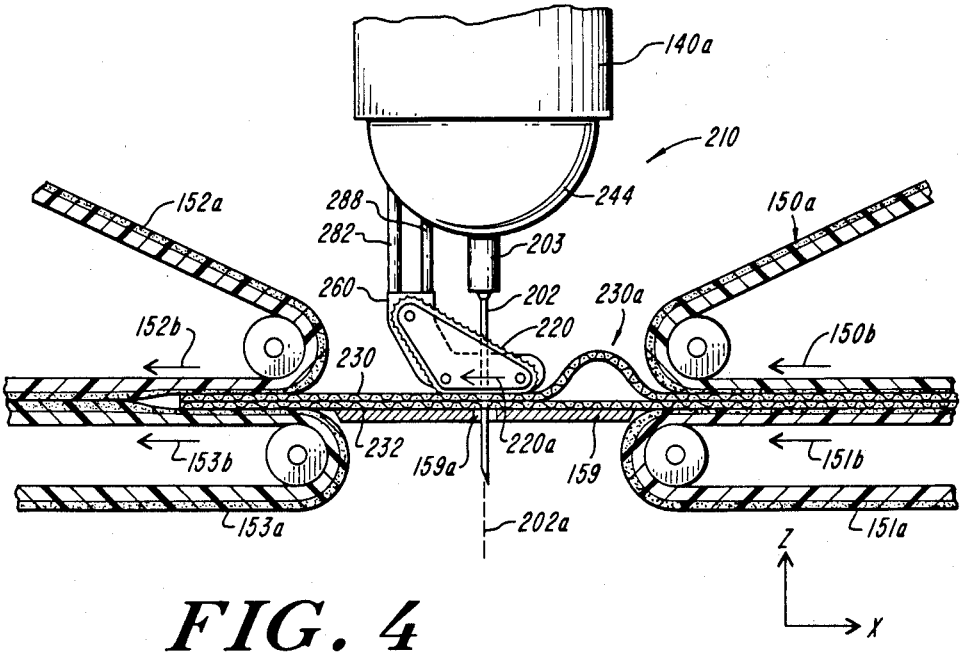
FIG. 4 is a side elevation view of the feeder assembly and related elements of the system of FIG. 1.

FIG. 4 shows a side elevation and part-sectional (i.e., through the retracted belt portions upper belt material drive assemblies 150 and 152) view of a portion of the assembly system 110. In FIG. 4, elements corresponding to elements in FIGS. 1–3B are shown with identical reference designations. The portion of system 110 shown in FIG. 4 is particularly adapted illustrate the assemblage of a seam (with easing) in a workpiece having an upper limp fabric layer 230 and a lower limp fabric layer 232. In FIG. 4, the workpiece support surface 158 is established by element 159 and the upper surface of left material drive belt 153*a* (of belt material drive assembly 153), the upper surface of right material drive belt 151*a* (of belt material drive assembly 151), as well as the fixed surfaces (not shown in FIG. 4) surrounding those upper surfaces of the belts. The lower surfaces of left material drive belt 152*a* (of belt material drive assembly 152) and right material drive belt 150*a* (of belt material drive assembly 150 are biased toward the workpiece support surface.

In the configuration of FIG. 4, the belts 220 and 222 of feeder assembly 212 are each positioned about a set of three rollers which are rotatably coupled to a feeder frame member 260 (which in turn is non-rotatably coupled to the coupler 214).

To accomplish the desired seam with easing, the controller 124 (including its associated drive motors and linkages) drives the belts 151*a*, 152*a*, and 153*a* so that their outer surfaces move the arrows 151*b*, 152*b* and 153*b* at a velocity M, drives belt 150*a* so that its outer surface moves (in the direction of the arrow 150*b*) at a velocity M+E, and drives the belts 220 and 222 (in the direction of the arrow 220*a* in FIG. 4) at a desired velocity between M and M+E so that a wave of material layer 230*a* is generated and an eased seam may be formed. In the preferred embodiment, the method and apparatus for driving the belts 150–152, and for controlling the synchronized retraction of the appropriate ones of the upper belts 150 and 152 are the same as those disclosed in U.S. Pat. No. 4,632,046.

Figure 5:
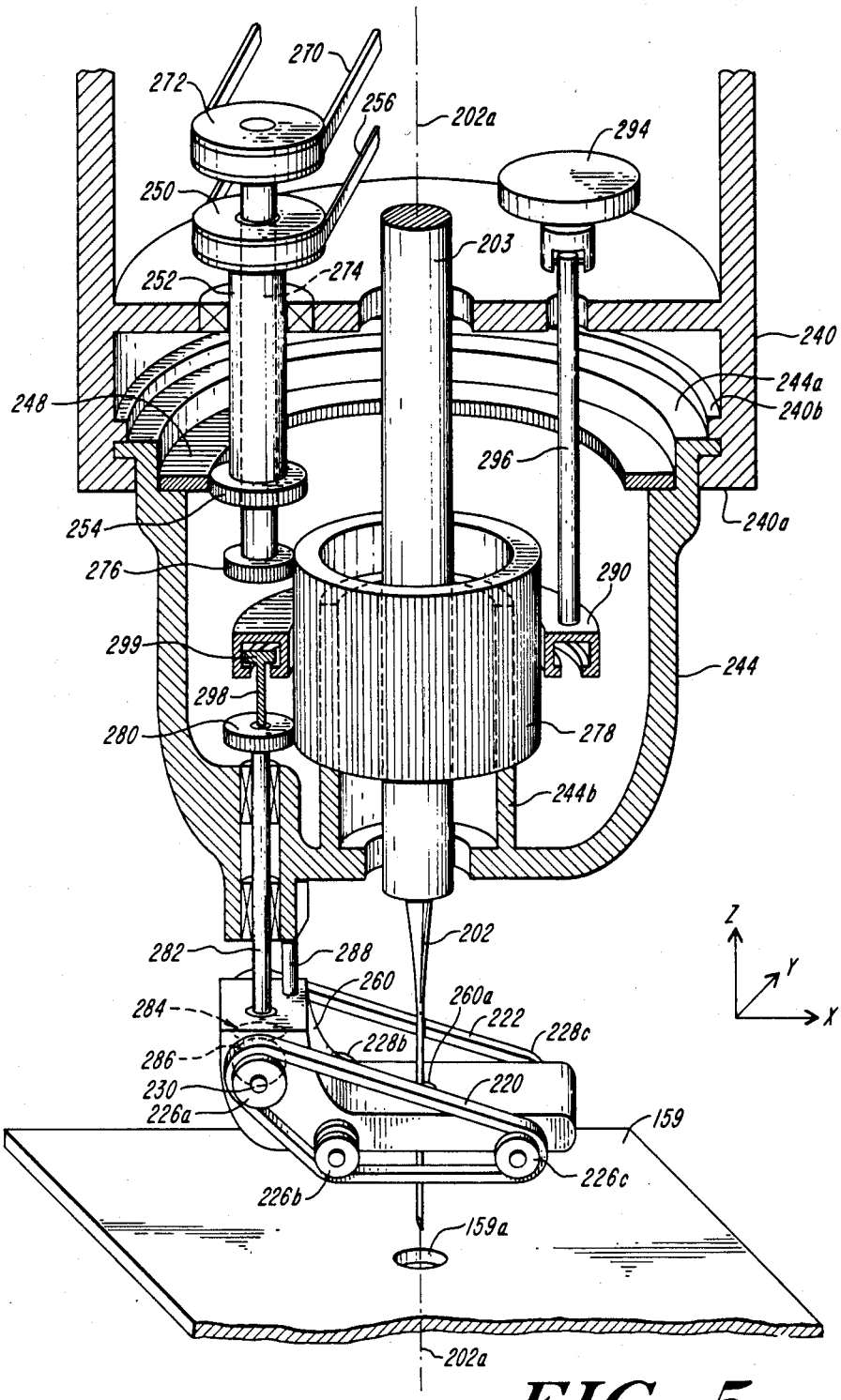
FIG. 5 shows a partially perspective, partly sectional view of the feeder assembly of the system of FIG. 1.

The preferred form of the feeder assembly 210 is shown in perspective (and partially sectional) view in FIG. 5. The feeder assembly 210, principally including the coupler 214 and feeder 212 (including belts 220 and 222), also incorporates a stationary base member 240 of the housing of sewing head 140*a* of sewing machine 140. The needle 202 and its associated bar drive member 203 extends through the base member 240 along the needle axis 202*a*. The base member 240 functions as a stable, non-rotating "ground" for the coupler 214 and feeder 212 of feeder assembly 210. The lowermost portion of base member 240 includes a pair of vertically spaced apart, inwardly extending lips 240*a* and 240*b*.

The coupler 214 includes a cup-shaped housing 244 having an outwardly extending peripheral lip 244*a* positioned between the lips 240*a* and 240*b* of base member 240, permitting free sliding rotation (about axis 202*a*) of cup housing 244 with respect to the base member 240. An internal ring gear 248 is affixed to the upper end of cup housing 244. A drive pulley 250 within base member 240 is coupled by way of a shaft 252 (journalled to base member 240) and a drive gear 254 to the ring gear 248. With this configuration, a belt 256 may be remotely driven by a motor (not shown) under the control of controller 124 to selectively rotate the cup housing 244 about the needle axis 202*a*.

The feeder 212 includes a frame member 260 which supports a set of belt support rollers on opposite sides of the needle axis 202*a*. In the present embodiment, frame member 260 includes an aperture 260*a* about the needle axis 202*a*, permitting passage of the needle 202. Three point endless belts 220 and 222 are each supported by one of the sets of rollers, such that each belt has a lowermost surface substantially parallel to the principal plane of element 159 of support surface 158. Rollers 226*a*, 226*b* and 226*c* support belt 220 and rollers 228*a* (not shown), 228*b* and 228*c* support belt 222. In other embodiments, different belt configurations may be used. For example, belt 220 might be replaced by a pair of two point endless belts, with one belt supported by rollers 226*a* and 226*b* and the other supported by rollers 226*b* and 226*c*.

In the presently described embodiment, the rollers 226*a* and 228*a* are coupled by central shaft 230 so that rotary motion of those rollers establishes corresponding motion of both belts 220 and 222. The rollers 226*a* and 228*a* are adapted to be selectively driven under the control of controller 124 by way of a feeder drive system. That feeder drive system includes a motor (not shown) controlled by controller 124 and coupled by a belt 270. The belt 270 drives a pulley 272, internal shaft 274 (disposed within and journalled to shaft 252), gear 276, main sun gear 278 (journalled to a support portion 244*b* of cup housing 240), gear 280, shaft 282 (coupled to cup housing 244 to permit rotary motion of that shaft about an axis parallel to axis 202*a* and to permit axial motion of that shaft in the direction of that axis, both with respect to the cup housing 244, and also journalled to frame member 260), mitre gear 284, and mitre gear 286 (affixed to shaft 230). With this configuration, the motion of belt 270 (as established by controller 124) effects corresponding motion of the belts 220 and 222. The orientation of the frame member 260 is fixed with respect to the cup housing 244 by means of shaft 282 and a bar member 288 (which extends from frame member 260 and is slidingly coupled to cup housing 244 in the direction of an axis parallel to axis 202*a*.

Figure 6:
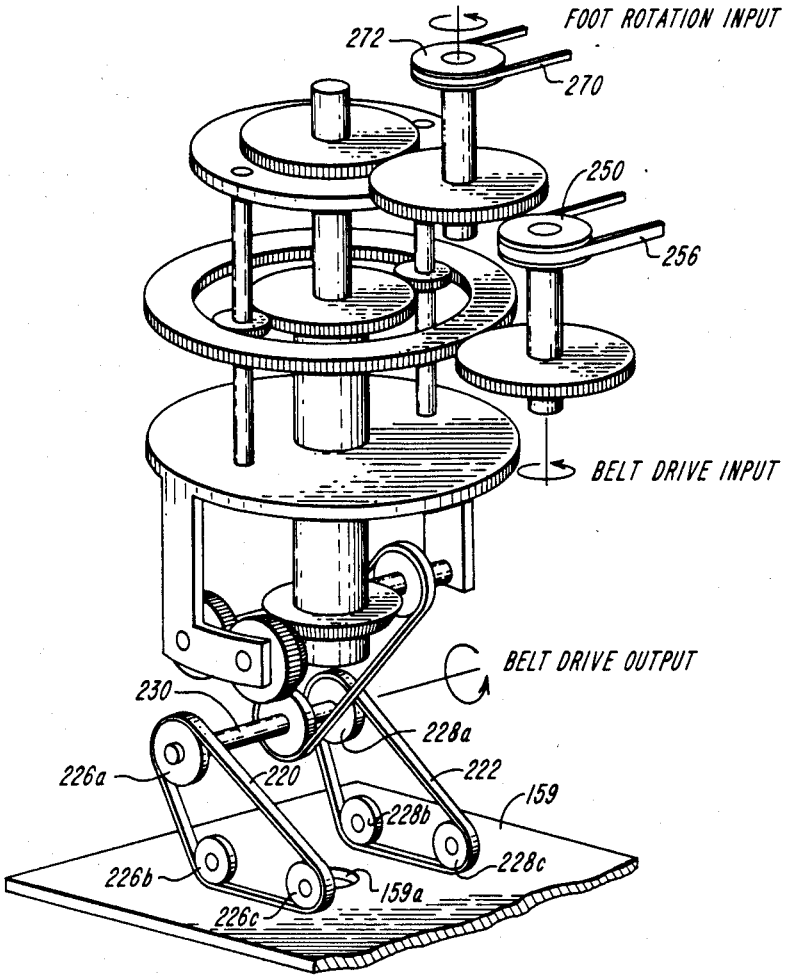
FIGS. 6 and 7 show schematic representations of alternate systems for driving and rotating the near-needle belts of a feeder assembly in accordance with the present invention.
Figure 7:
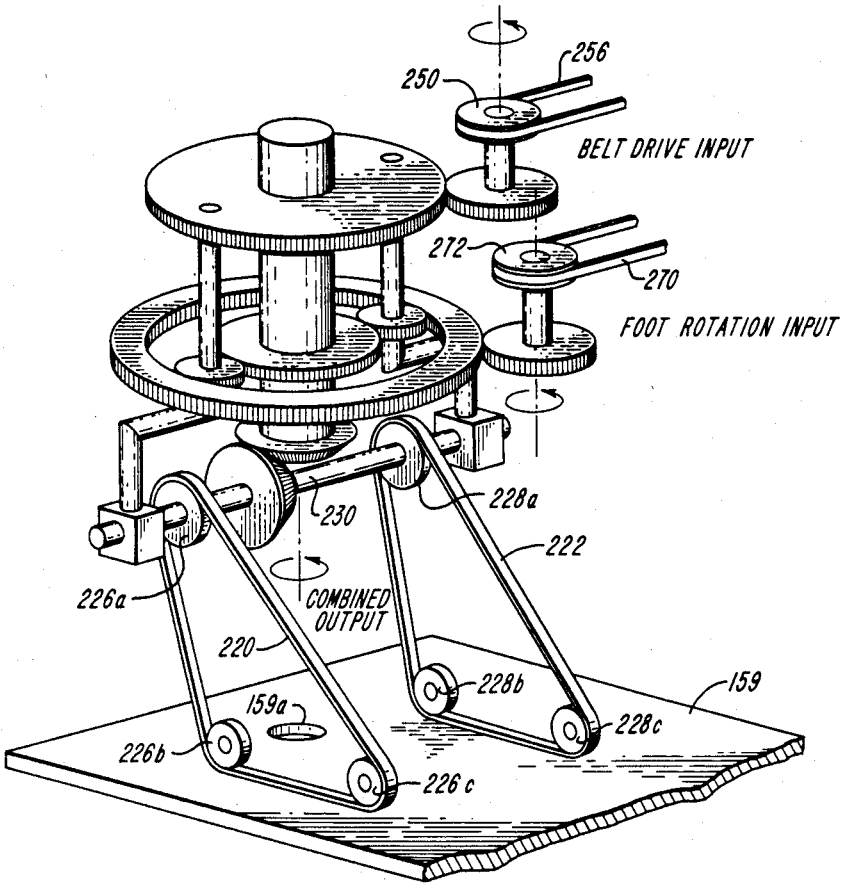

FIGS. 6 and 7 schematically illustrate two alternative drive systems which may be used to drive belts 220 and 222, and rotate the frame member 260 (and thus the belts 220 and 222), in lieu of the exemplary systems shown in FIG. 5.

A height control assembly selectively controls (under the control of controller 124) the position of the frame member 260 with respect to the cup housing 244 in the direction of axis 202*a*. That height control assembly includes a set of pneumatic actuators affixed to base member 240. Each actuator includes an associated lift rod (adapted for linear motion along an axis parallel to axis 202*a*. The respective lift rods are rigidly coupled at their distal ends to a T-slotted ring 290 disposed within the cup housing 244. In FIG. 5, one actuator 294 and its associated lift rod 296 is shown, although, preferably at least two additional actuators and lift rods are used in addition to provide optimal positional control of the ring 290. The height control assembly futher includes a T-shaped cross-section member 298 extending from the gear 280, where the top portion 299 of member 298 is disposed within the T-shaped slot of ring 290. With this configuration, the pneumatic actuators control the position of ring 290, which (by way of member 298, gear 280 and shaft 282) controls the position of frame member 260 with respect to base member 240 and the element 159 of the workpiece support surface 158. With this configuration, controller 124 may selectively control the lower surfaces of belts 220 and 222 to be biased toward a workpiece betwen those surfaces and element 159 or lifted away from such a workpiece. In order to permit active control of the belts 220 and 222 throughout the full vertical range of motion of frame member 260, the sun gear 278 is provided with adequate length in the direction of axis 202*a* so that the gear 280 is coupled to that gear 278 at all times.

Thus, with the exemplary configuration of FIG. 5, the feeder assembly 210 permits full 360 degree rotary control of the belts 220 and 222 relative to the fixed sewing head 140*a* of sewing machine 140, as well as vertical (Z axis) motion control of those belts, all under the control of controller 124. The belts 220 and 222 provide precise near-needle control of the workpiece while providing any desired angle of presentation to the needle 202*a*. The independent control of all material drive belts in the system thus cooperatively provide a high degree of workpiece control to permit the generation of precise curvilinear seams with virtually any degree of curvature, as well as with easing, as desired.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A sewing machine system for joining portion of a multiple layer limp fabric workpiece, comprising:

A. a substantially planar workpiece support surface,

B. an elongated needle,

C. a sewing head assembly including selectively operable needle drive means for driving said needle along a needle axis offset from said support surface, whereby a tip of said needle passes in a reciprocating motion through an aperture in said support surface, D. a selectively operable feeder assembly including feed means for transporting a region of said limp fabric workpiece on said support surface and adjacent to said needle axis in the direction of a feed axis, said feed axis having a fixed orientation with respect to said feeder assembly, E. a coupling assembly including means for rotatably coupling said feeder assembly to said sewing head assembly whereby said feeder assembly is selectively rotatable about said needle axis, and F. a controller including:

i. a feed controller means for selectively controlling said feeder assembly to be operative, ii. an orientation controller means for selectively controlling the angular orientation of said feeder whereby said feed axis may be adjustably offset at any angle within a predetermined range R, where R is greater than zero degrees measured with respect to a reference axis on said support surface, wherein said feeder assembly includes:

i. a feeder frame member, ii. an endless belt assembly including at least one endless belt disposed about an associated set of rotatable support members affixed to said feeder frame member, each of said belts having a portion of its outer surface lying substantially in a reference plane, said reference plane being substantially parallel to and above said planar workpiece support surface in the region adjacent to said aperture, said portions of said outer surfaces of said belts being adapted for motion along respective belt axes, said belt axes lying in said reference plane and being mutually parallel and disposed on opposite sides of said needle axis, iii. selectively operable drive motor and associated linkage responsive to said feed controller means, said drive motor and associated linkage including means for driving each of said belts about its associated set of support members.

2. A sewing machine system according to claim 1 wherein said belts include outer surfaces adapted to engage said limp fabric workpiece with a relatively high coefficient of friction.

3. A sewing machine system according to claim 1 wherein said feeder assembly further includes bias means to selectively bias said portions of said outer surfaces of said belts in the direction toward said support surface, and wherein said feed controller means includes means for controlling said bias means whereby said bias is substantially at a selected value.

4. A sewing machine system according to claim 1 wherein said coupling assembly includes multistate retraction means operable in a first state for controlling the position of said feeder assembly to be in a position whereby said portions of said outer surfaces of said belt are biased in the direction toward said support surface, and operable in a second state for controlling the position of said feeder assembly whereby said portions of said outer surfaces of said belts are displaced by a predetermined distance from said support surface, and wherein said controller includes means for selectively controlling said retraction means to be operative in one of said first and second states.

5. A sewing machine system according to claim 1 wherein said endless belt assembly includes two endless belts.

* * * * *